US009200219B2

(12) United States Patent
Lack

(10) Patent No.: US 9,200,219 B2
(45) **Date of Patent: *Dec. 1, 2015**

(54) STRONG BASE AMINES TO MINIMIZE CORROSION IN SYSTEMS PRONE TO FORM CORROSIVE SALTS

(71) Applicant: Baker Hughes Incorporated, Houston, TX (US)

(72) Inventor: Joel E. Lack, Sugar Land, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/688,190

(22) Filed: Apr. 16, 2015

(65) Prior Publication Data

US 2015/0218467 A1 Aug. 6, 2015

Related U.S. Application Data

(62) Division of application No. 13/312,225, filed on Dec. 6, 2011, now Pat. No. 9,023,772.

(60) Provisional application No. 61/421,018, filed on Dec. 8, 2010.

(51) Int. Cl.

| | |
|---|---|
| ***C07D 207/26*** | (2006.01) |
| ***B01D 19/04*** | (2006.01) |
| ***C10G 29/00*** | (2006.01) |
| ***C10G 75/02*** | (2006.01) |

(52) U.S. Cl.

CPC ..... *C10G 75/02* (2013.01)

(58) Field of Classification Search

CPC ..... C10G 29/20; C10M 2207/125; C10M 2215/221; C10M 2217/06; C10M 2215/04

USPC ..... 208/289; 508/154, 262, 268, 545

See application file for complete search history.

(56) References Cited

U.S. PATENT DOCUMENTS

| | | | | |
|---|---|---|---|---|
| 2,889,276 | A | 6/1959 | Barrett et al. | |
| 3,458,453 | A | 7/1969 | Kautsky | |
| 4,430,196 | A | 2/1984 | Niu | |
| 4,806,229 | A | 2/1989 | Ferguson et al. | |
| 5,211,840 | A | 5/1993 | Lehrer et al. | |
| 5,965,785 | A | 10/1999 | Braden et al. | |
| 9,023,772 | B2 | 5/2015 | Lack | |
| 2005/0051462 | A1 * | 3/2005 | Lack et al. | 208/47 |

* cited by examiner

*Primary Examiner* — Vishal Vasisth

(74) *Attorney, Agent, or Firm* — Mossman Kumar & Tyler PC

(57) ABSTRACT

Corrosion by ammonia/amine salts in hydrocarbon streams such as distillation overhead streams that contain a mineral acid and water can be prevented, avoided or minimized by adding certain strong amines to the streams. The amines have a pKa between about 10.5 to about 12 and include, but are not necessarily limited to, dimethylamine, diethylamine, dipropylamine, diisopropylamine, di-n-butylamine, diisobutylamine, di-sec-butylamine, di-tert-butylamine, pyrrolidine, piperidine, and combinations thereof. If the hydrocarbon stream further includes a nitrogen-containing compound such as ammonia, a tramp and/or a residual amine which can form a corrosive salt with the mineral acid, then the added amine is a stronger base than the tramp or residual amine, if present. The amount of added amine is greater than total amount of nitrogen-containing compound, so that any corrosive salts formed are less corrosive than the salts that would otherwise form from the ammonia and/or tramp amine.

20 Claims, 3 Drawing Sheets

Corrosion Rate of Carbon Steel Exposed to 1M & 5M Salt Solutions at 160°F (71°C)

Corrosion Rate of Carbon Steel Exposed to 1M & 5M Salt Solutions at 160°F (71°C)

Corrosion Rate of Carbon Steel Exposed to a Saturated Salt Solution at 160°F (71°C)

Corrosion Rate Reduction By Mixing in Strong Base Amine Salts on Carbon Steel at 160°F (71°C), mpy (mm/yr)

STRONG BASE AMINES TO MINIMIZE CORROSION IN SYSTEMS PRONE TO FORM CORROSIVE SALTS

CROSS-REFERENCE TO RELATED APPLICATION

The present application is a divisional application from U.S. patent application Ser. No. 13/312,225 filed Dec. 6, 2011, issued May 5, 2015, as U.S. Pat. No. 9,023,772, which in turn claimed the benefit of U.S. Provisional Patent Application No. 61/421,018 filed Dec. 8, 2010, all of which are incorporated herein by reference in their entirety.

TECHNICAL FIELD

The present invention relates to methods and compositions for forming acid salts in hydrocarbon streams that are less corrosive than those presently formed, and more particularly relates, in one non-limiting embodiment, to methods and compositions for using relatively strong amines to minimize corrosion in systems containing hydrocarbon streams that include water and mineral acids.

BACKGROUND

In the refining of petroleum products, such as crude oil, hydrochloric acid is generated which can cause high corrosion rates on the distillation unit metallurgy, including the overhead system. Neutralizing amines are added to the overhead system to neutralize the hydrochloric acid (HCl) and make it less corrosive. However, excess amines can form salts that will also lead to corrosion. Consequently, the refining industry has, for many years, suffered from amine-hydrochloride salt deposition in crude oil distillation towers, overhead and pumparound circuits. The problem occurs when ammonia and/or amines are present in the desalted crude. These amines react with hydrochloric acid and other acids while ascending the crude tower and deposit as corrosive salts in the tower and the top pumparound equipment. The amines can be present from several sources, including but not necessarily limited to, crude oil (e.g. hydrogen sulfide ($H_2S$) scavenger chemicals—amines added to neutralize the corrosive and other deleterious effects of $H_2S$), slop oil (frequently containing gas scrubbing unit amines) and desalter wash water (often composed of overhead sour water containing amine neutralizer). The problem has worsened in recent years in part due to higher crude salt content, which yields higher HCl contents as a by-product and in turn requires more overhead neutralizer, consequently both salt reactants are present in higher quantities. Additionally, market conditions have encouraged many crude towers to be operated at a colder top temperature, which further encourages salt formation in towers. Longer run cycles between turnarounds have caused the problem to become a priority. Clearly, amine salting in towers has become a bigger problem in recent years, and future trends indicate continuation of the problem.

In a specific instance, a unit has an excessive level of ammonia that contributes to salt formation and the operators are processing above design so that the stream velocities are too high to use a water wash (a common remedy for salts) without experiencing velocity-accelerated corrosion. In a second specific example the operators desire to process a crude oil with a tramp amine. The use of an acid upstream at the desalter reduces the amine to a level that does not form a salt, but the cost of the acid treatment is high.

Solutions examined thus far fall into two categories. First, for cases where the amine is coming in with the crude oil or slop oil, the primary option is to segregate the offending streams and keep them out of the crude unit. This approach is economically unattractive in many cases. Second, in cases where the problem occurs due to recycle of overhead neutralizer by use of the distillation overhead water as a desalter wash source, the approach has been to switch to overhead amines that will not form a salt at tower conditions or use another desalter wash source. These techniques are also economically unattractive in most applications, since these alternative neutralizers cost from three to four times as much as the conventionally used amines.

Additional changes are foreseen which are likely to make the problem even worse. The economic incentive to use discounted crudes has led to a general deterioration of crude quality, and further, more plants are attempting to maximize internal water reuse. A recent effort to design new amine neutralizer options for overhead systems does not offer relief in all cases, because such amines will not help in systems where salts are present from ammonia or tramp amines entering the system with crude oil or slop oil.

It would be desirable if methods and/or compositions could be devised that would reduce, alleviate or eliminate corrosion caused by undesired amine salts where amines enter refinery towers and at other locations.

SUMMARY

There is provided, in one non-limiting embodiment, a method of reducing corrosion in a petrochemical process that includes a stream containing at least one hydrocarbon, water and at least one mineral acid. The method involves contacting the stream with a composition that includes at least one amine having a pKa between about 10.5 to about 12, where the amine does not contain oxygen. In the context of this application, it should be understood that pKa values noted are those reported at room temperature, typically at 20-25° C.

There is also provided, in another non-restrictive version a treated hydrocarbon stream having reduced corrosion capability which stream includes at least one hydrocarbon, water, at least one mineral acid, and a composition containing at least one amine having a pKa between about 10.5 to about 12, where the amine does not contain oxygen.

DETAILED DESCRIPTION

Figure 1:
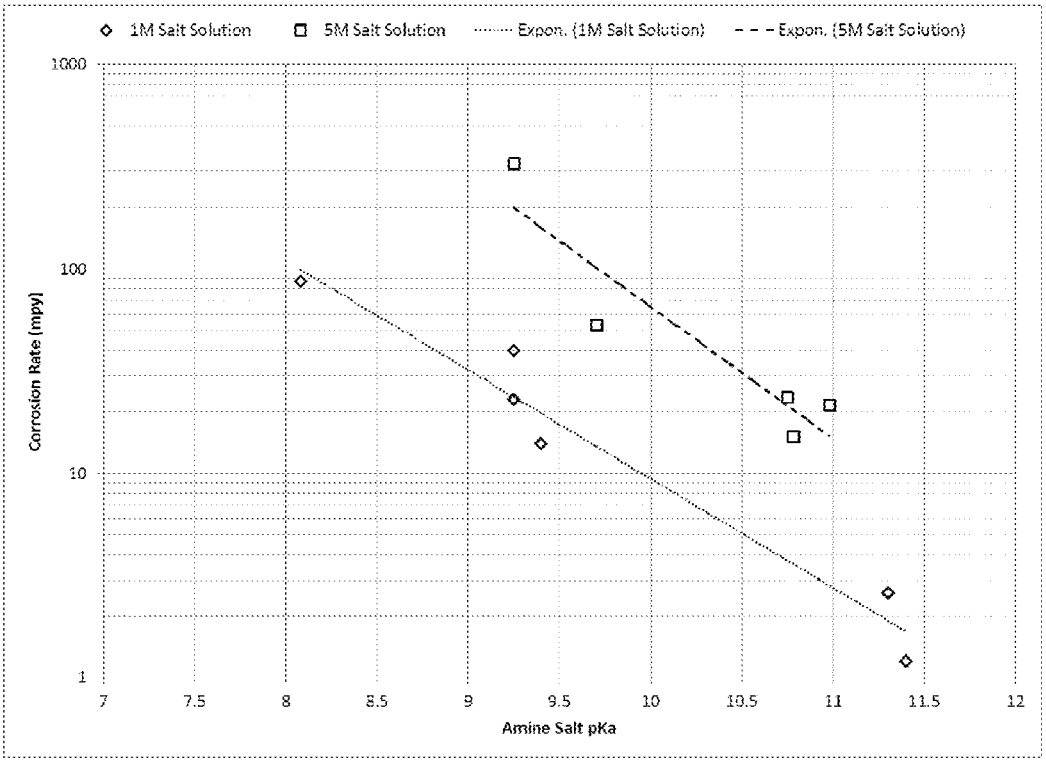
FIG. 1 is a graph of the exponential relationship of amine pKa to the corrosion rate of the salt for carbon steel exposed to 1M and 5M salt solutions at 160° F.
Figure 2:
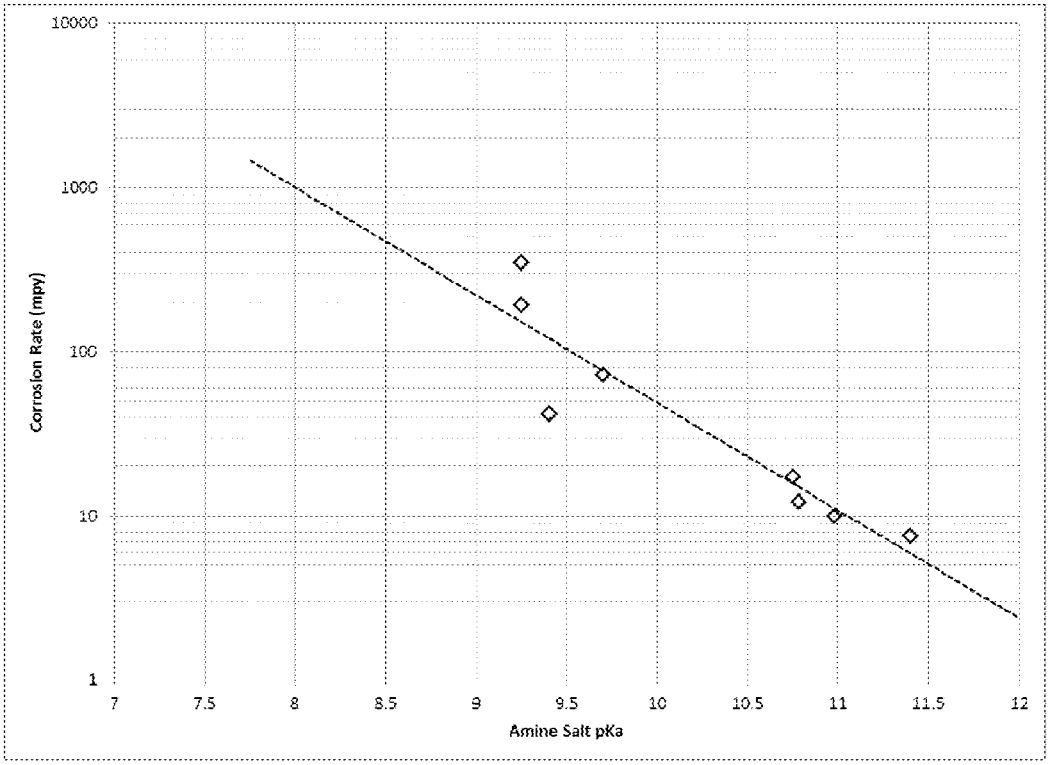
FIG. 2 is a graph of the exponential relationship of amine pKa to the corrosion rate of the salt for carbon steel exposed to a saturated salt solution at 160° F. (71° C.)

Tramp or residual amines and/or ammonia from desalted crude oil streams or other hydrocarbon streams where ammonia or amines may be present from any source may over time and/or under certain conditions contact reactants and form undesirable corrosive products. The term "stream" is defined herein as any flowing fluid in a petrochemical process, and more particularly streams containing at least one hydrocarbon, water and at least one mineral acid. Organic amines and ammonia are frequently present in the desalted crude oil as contaminants from upstream treatment, via desalter wash water or from introduction of slop oils. These basic compounds can, under certain conditions, react with HCl and other acids to form corrosive salts. The conditions in crude distillation towers often favor these reactions. The fouling and corrosion that results from the formation of the salts increases the refinery operating and maintenance costs significantly. Efforts to minimize or exclude the tramp bases from the unit feed streams are often ineffective or economically infeasible. Consequently, there is a need for another means of removing these bases from the desalted crude or avoiding their use. There is also a need to inhibit or prevent corrosion caused by mineral acids present in these streams in the first place.

Volatile amines herein include any amine capable of reaching a tower overhead and capable of forming a deposit under unit conditions, i.e. during a hydrocarbon processing operation. In another non-limiting embodiment, volatile amines include, but are not necessarily limited to, ammonia, amines of the formula R—NR'—R", where R, R' or R" is independently hydrogen, a straight, branched, or cyclic alkyl or aromatic group, where R, R' or R" independently has from 1 to 10 carbon atoms and where R, R' or R" independently may be substituted with one or more oxygen atoms and/or nitrogens, the latter substitution permitting the structure R—NR'—R" to encompass diamines and/or polyamines. Amines and diamines containing oxygen also fall within the definition of volatile amines. More specific examples of volatile amines include, but are not necessarily limited to, methylamine; alkanolamines that may include, but are not necessarily limited to, monoethanolamine (MEA), methyldiethanolamine (MDEA), diethanolamine (DEA), diglycolamine (DGA); diamines such as ethylenediamine (EDA); other amines containing oxygen, including, but not necessarily limited to methoxypropylamine (MOPA), diethylaminoethanol (DEAE) and the like and mixtures thereof.

It has been discovered that relatively stronger base amines (compared to those conventionally used) may be used as neutralizers in petrochemical processes where strong acids such as hydrochloric acid (HCl), hydrobromic acid (HBr), sulfuric acid ($H_2SO_4$) and the like are used may form relatively less corrosive amine salts as compared with the amine salts presently being formed. That is, the strongly basic amines may react with the strong acids to form corrosive, but relatively weak acid salts. The corrosivity of the salt is associated with the strength of the salt's acid. Stronger bases give weaker acid salts with a strong acid. It has been found that use of these stronger base amines can significantly reduce corrosion rates in systems where salt formation cannot be avoided.

More specifically, the useful amines include relative stronger amines having a pKa between about 10.5 to about 12. In one non-limiting embodiment, the amine does not contain oxygen. The amines may contain other non-carbon, non-hydrogen atoms besides oxygen. In another non-restrictive version, the amines are di-alkylamines which have a pKa range of between about 10.7 to about 11.4. In a different non-limiting embodiment the amine has a normal boiling point greater than 95° C. Suitable amines include, but are not necessarily limited to, dimethylamine, diethylamine, dipropylamine, diisopropylamine, di-n-butylamine, diisobutylamine, di-sec-butylamine, di-tert-butylamine, pyrrolidine, piperidine, and combinations (e.g. mixtures) thereof. In one specific non-limiting embodiment di-n-butylamine (DBA) is particularly suitable due to a combination of base strength, a pKa of about 11.4, and handling properties, a flash point of greater than 100° F. (38° C.). In one non-limiting embodiment, one or more of the following amines are excluded from the at least one amine that is used to contact the stream containing a hydrocarbon, water and a mineral acid: ethylamine, diethylamine, isopropylamine, n-butylamine, sec-butylamine and/or triethylamine. It is believed that each of these amines has a normal boiling point of less than 95° C.

The amines may be added as sole additives or as an additive composition. In an alternative non-restrictive version only one amine is contacted with the stream. Suitable solvents in an additive composition include, but are not necessarily limited to, water or hydrocarbon distillates. Certain of the amines, such as di-n-butylamine, may be introduced or injected as a pure product. Solvents would be used mainly to achieve desired handling properties, such as improved flash points or improved pour/freeze points. The amount of total amine in an additive composition should be at least about 1 wt %, in another non-limiting embodiment at least about 2 wt %, in another non-restrictive version at least 5 wt %. Alternatively, the amount of any one single amine in an additive composition should be at least about 1 wt %, in another non-limiting embodiment at least about 2 wt %, in another non-restrictive version at least 5 wt % each. In one non-restrictive version, the amine composition has an absence of amides.

The methods and compositions herein involve injecting the composition into petrochemical processes for neutralization of condensing acidic water where strong acids are present. Strong acids as defined herein include, but are not necessarily limited to, HCl, HBr, $H_2SO_4$ and combinations thereof. Weak acids may also be present including sulfur dioxide ($SO_2$), carbon dioxide ($CO_2$), light organic acids (including, but not necessarily limited to, formic acid, acetic acid, propionic acid, butyric acid, pyruvic acid, valeric acod, isovaleric acid, and the like), and combinations thereof. In one non-limiting embodiment, the stream being treated is a hydrocarbon stream, and may be a desalted crude oil stream in particular. Optionally, the stream additionally comprises $H_2S$. Alternatively, in a different non-restrictive version, there is an absence of $H_2S$. The presence of common tramp amines or residual amines that lead to undesirable salting include amines such as, but not necessarily limited to, monoethanolamine (MEA), methyldiethanolamine (MDEA), diethanolamine (DEA), diglycolamine (DGA); diamines such as ethylenediamine (EDA); other amines containing oxygen, including, but not necessarily limited to methoxypropylamine (MOPA), diethylaminoethanol (DEAE) and the like and mixtures thereof.

Suitable injection points for the relatively stronger amines described herein include, but are not necessarily limited to, desalted crude streams, distillation or stripper column feed streams, overhead streams, reflux, and combinations thereof.

A more specific and optional method involves injecting the claimed composition into a process environment where ammonia and/or amines naturally present or intentionally added would react with the strong acids present to form corrosive salts, with the intent of forming a less corrosive salt with the stronger base amines, thereby reducing the corrosion rate of the various metallurgies with which the hydrocarbon stream comes into contact. In other words, the hydrocarbon stream further includes a nitrogen-containing compound such as ammonia, a tramp amine, a residual amine or combinations thereof, which ammonia and/or amine are capable of forming at least one corrosive salt with any mineral acid. The strong amine added is different from and stronger than the tramp amine or residual amine, if one is present. It is further expected that the amount of strong amine added would be greater than total amount of nitrogen-containing compound. It may be important to have significantly more of the stronger base over the amount of ammonia or tramp amine in the treated stream, but without exceeding a pH of 7.5 where the water of the treated stream is sampled downstream, such as at the overhead accumulator. This sampling should be done after the amine has sufficiently reacted with the mineral acid in the stream, which may be understood as when the pH has increased to a stable point and has not effectively further changed. In general, the pH of the treated hydrocarbon stream may range from about 5.5 independently to about 7.5, alternatively from about 6 independently to about 7. This is the pH of the water in the treated stream. The term "independently" as used herein means that any lower threshold may be combined with any upper threshold to give an acceptable alternate range.

Typical application of the strong amines may involve the addition of at least approximately an amount that is stoichiometrically functionally equivalent to the mineral acid present in the treated hydrocarbon stream. In another non-limiting embodiment, this may range between about 0.1 and independently about 100 ppm of additive injected into the desalted crude. In another non-restrictive version, the addition proportion ranges between about 10 and independently about 300 ppm in the overhead water stream. Alternatively, the addition of amine may be at a rate of up to about 5 times the amount of acid present in the petroleum fluid or hydrocarbon stream; in another non-limiting embodiment, at a rate of up to about 2 times the amount of acid present. Testing indicates that there is typically sufficient time and temperature for the desired reaction to occur. In any event, sufficient time and/or conditions should be permitted so that the amine reacts with substantially all of the acid present. By "substantially all" is meant that the resulting amine salts present reduced corrosion problems as compared to the corrosive amine salts that would otherwise form without the addition of the strong amines described herein.

The methods and compositions described herein will be useful in cases where salts cannot be controlled due to physical or economic limitations. In one non-limiting embodiment, these methods and compositions are expected to be useful in petrochemical processes, which processes include, but are not necessarily limiting to, petroleum refining, olefins and aromatics manufacturing and other processes using hydrocarbon feedstocks from oil, natural gas, living biomass or recycled petroleum products. Goals include intentionally making a nearly non-corrosive salt and significantly reducing the current salt corrosion rates. It will be understood that the complete elimination of corrosive salt formation is not required for successful practice of the methods described herein. All that is necessary for the method to be considered successful is for the treated hydrocarbon stream to have reduced corrosion capability as compared to an otherwise identical hydrocarbon stream having an absence of the added strong amine.

The invention will now be described with respect to particular Examples that are not intended to limit the invention but simply to illustrate it further in various non-limiting embodiments.

Example 1

In theory, the hydrochloride salt of ethylamine should be less corrosive than the ammonium chloride salt. The ethylaminium ion has a pKa of 10.75—significantly weaker that the ammonium pKa of 9.25. The pH of the ethylamine HCl salt is expected to be 0.75 higher than that of ammonium chloride. This means that ammonium chloride will generate 5.6 times the hydrogen ions and, in theory, 5.6 times the corrosion rate. Table 1 shows the results of carbon steel exposed to 5M molar solutions of ammonium chloride and ethylamine HCl near standard conditions at 75° F. (24° C.). The differences were close to the predicted values. The corrosion rate of mpy is mils per year.

TABLE 1

Effect of pKa on pH and Corrosion Rate

| Property | pH | Corrosion Rate on CS (mpy) |
|---|---|---|
| Ammonium chloride | 4.84 | 29.3 |
| Ethylamine HCl | 5.73 | 4.4 |
| Difference | 0.89 | 6.7x |

Example 2

A test was run of saturated solutions of ammonium chloride, ethylamine (EA) hydrochloride and a 50/50 blend of the two at 160° F. (71° C.). As noted, ammonia has a pKa of 9.25 while that of EA is 10.75. The ammonia salt had a corrosion rate on carbon steel of 349 mpy (8.9 mm/yr) while the EA salt only corroded at 17 mpy (0.4 mm/yr). The mixture showed a corrosion rate of 146 mpy (3.7 mm/yr) confirming that the corrosivity of a weaker base HCl salt can be reduced with the addition of a stronger base.

Example 3

Figure 3:
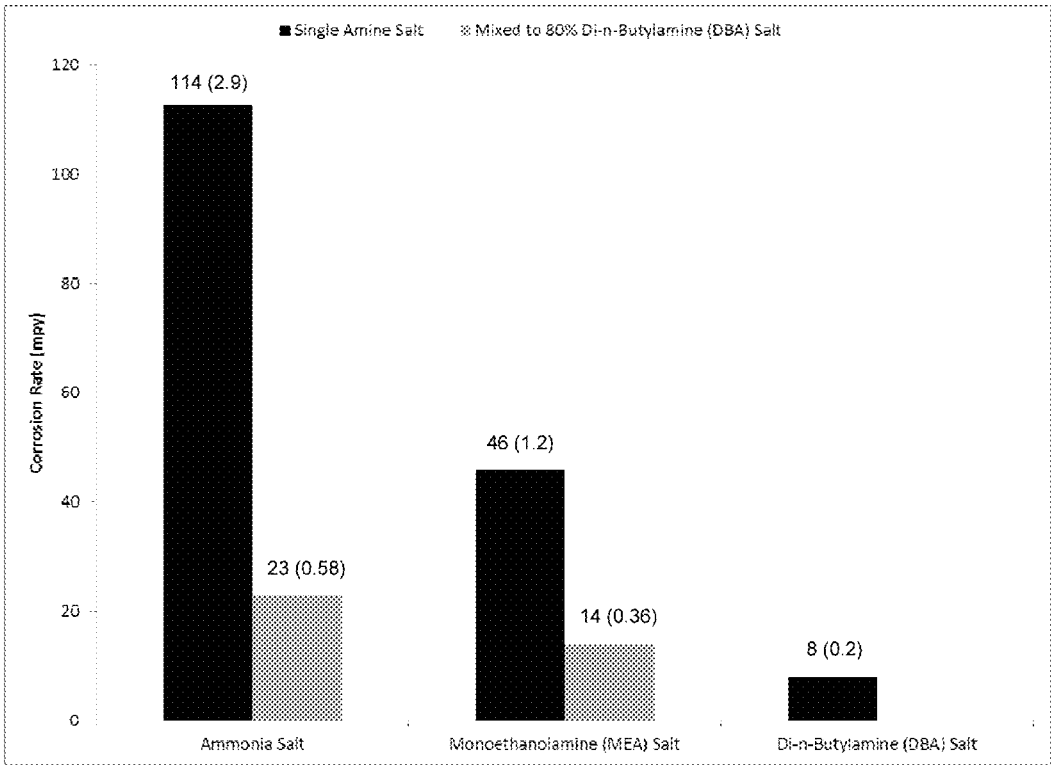
FIG. 3 is a graph showing the reduced corrosion rates obtained when mixing 80% of the strong base di-n-butylamine salt with 20% of weaker base ammonia and monethanolamine salts.

Ammonia and monoethanolamine (MEA) are two common contaminants that form salts. Carbon steel coupons were exposed to 1M solutions of the HCl salt of each amine in a deaerated environment. The resulting metal loss revealed a corrosion rate of 114 mpy for the ammonia salt and 46 mpy for the MEA salt. The HCl salt of a strong base amine, di-n-butylamine (DBA), was also tested in the same manner with a resulting corrosion rate of only 8 mpy. The HCl salt of DBA was then added to the ammonia and MEA salt such that the strong base accounted for 80% of the total salt. The resulting corrosion on the carbon steel coupons was significantly reduced. The coupon exposed to the mixture with ammonia salt showed a corrosion rate of 23 mpy, an 80% reduction. The coupon exposed to the mixture with MEA salt showed a corrosion rate of 14 mpy, a 70% reduction. The graph in FIG. 3 shows the results of this test.

In the foregoing specification, the invention has been described with reference to specific embodiments thereof. The amines and methods of use described herein would be expected to be useful in other hydrocarbon processing operations besides those explicitly mentioned. It will be evident that various modifications and changes can be made to the methods and compositions without departing from the broader spirit or scope as set forth in the appended claims. Accordingly, the specification is to be regarded in an illustrative rather than a restrictive sense. For example, specific acids, amines, hydrocarbons, streams and proportions thereof falling within the claimed parameters, but not specifically identified or tried in particular compositions, are anticipated and expected to be within the scope of this invention.

The words "comprising" and "comprises" as used throughout the claims is interpreted "including but not limited to".

The present invention may suitably comprise, consist or consist essentially of the elements disclosed and may be practiced in the absence of an element not disclosed. For instance, the method may consist of or consist essentially of contacting a hydrocarbon stream having water and at least one mineral acid with a composition consisting of or consisting essentially of at least one amine having a pKa between about 10.5 to about 12, where the amine does not contain oxygen. In another non-limiting embodiment, the treated hydrocarbon stream having reduced corrosion capability may consist of or consist essentially of at least one hydrocarbon, water, at least one mineral acid and a composition comprising at least one amine having a pKa between about 10.5 to about 12, where the amine does not contain oxygen, except that the treated hydrocarbon stream may have small amounts of naturally-occurring impurities.

What is claimed is:

1. A treated hydrocarbon stream having reduced corrosion capability comprising:

at least one hydrocarbon, water, at least one mineral acid, a composition comprising at least one amine having a pKa between 10.5 to 12, where the amine does not contain oxygen and has a normal boiling point greater than 95° C.; and at least one amine salt that is less corrosive as compared to amine salts that would otherwise form without the contacting of the composition comprising the at least one amine.

2. The treated hydrocarbon stream of claim 1 where the at least one amine is present in the treated hydrocarbon stream in an amount at least an amount that is approximately stoichiometrically functionally equivalent to the at least one mineral acid present in the treated hydrocarbon stream.

3. The treated hydrocarbon stream of claim 1 where the at least one amine is present in the treated hydrocarbon stream at a concentration of from between about 0.1 to about 300 ppm.

4. The treated hydrocarbon stream of claim 1 where the stream is selected from the group consisting of a desalted crude oil stream, a distillation overhead stream and combinations thereof.

5. The treated hydrocarbon stream of claim 1 where the at least one amine has a pKa between about 10.7 and about 11.4.

6. The treated hydrocarbon stream of claim 1 where the at least one amine is selected from the group consisting of dimethylamine, diethylamine, dipropylamine, diisopropylamine, di-n-butylamine, diisobutylamine, di-sec-butylamine, di-tert-butylamine, pyrrolidine, piperidine, and combinations thereof.

7. The treated hydrocarbon stream of claim 1 where the stream further comprises a nitrogen-containing compound selected from the group consisting of ammonia, a tramp amine, a residual amine, a volatile and combinations thereof capable of forming at least one corrosive salt with the at least one mineral acid, where the at least one amine is different from the tramp amine, residual amine, or volatile amine, and the amount of amine is greater than total amount of nitrogen-containing compound to give a treated stream.

8. The treated hydrocarbon stream of claim 7 where the pH of the water of the treated hydrocarbon stream is about 5.5 to about 7.5.

9. A treated hydrocarbon stream having reduced corrosion capability comprising:

at least one hydrocarbon, water, at least one mineral acid, a composition comprising at least one amine having a pKa between 10.5 to 12, where the amine does not contain oxygen and has a normal boiling point greater than 95° C., where the at least one amine is present in the treated hydrocarbon stream in an amount at least an amount that is approximately stoichiometrically functionally equivalent to the at least one mineral acid present in the treated hydrocarbon stream; and at least one amine salt that is less corrosive as compared to amine salts that would otherwise form without the contacting of the composition comprising the at least one amine;

where the stream is selected from the group consisting of a desalted crude oil stream, a distillation overhead stream and combinations thereof.

10. The treated hydrocarbon stream of claim 9 where the at least one amine is present in the treated hydrocarbon stream at a concentration of from between about 0.1 to about 300 ppm.

11. The treated hydrocarbon stream of claim 9 where the at least one amine has a pKa between about 10.7 and about 11.4.

12. The treated hydrocarbon stream of claim 9 where the at least one amine is selected from the group consisting of dimethylamine, diethylamine, dipropylamine, diisopropylamine, di-n-butylamine, diisobutylamine, di-sec-butylamine, di-tert-butylamine, pyrrolidine, piperidine, and combinations thereof.

13. The treated hydrocarbon stream of claim 9 where the stream further comprises a nitrogen-containing compound selected from the group consisting of ammonia, a tramp amine, a residual amine, a volatile and combinations thereof capable of forming at least one corrosive salt with the at least one mineral acid, where the at least one amine is different from the tramp amine, residual amine, or volatile amine, and the amount of amine is greater than total amount of nitrogen-containing compound to give a treated stream.

14. The treated hydrocarbon stream of claim 13 where the pH of the water of the treated hydrocarbon stream is about 5.5 to about 7.5.

15. A treated hydrocarbon stream having reduced corrosion capability comprising:

at least one hydrocarbon, water, at least one mineral acid, a composition comprising at least one amine having a pKa between 10.5 to 12, where the amine does not contain oxygen and has a normal boiling point greater than 95° C., where the at least one amine is present in the treated hydrocarbon stream at a concentration of from between about 0.1 to about 300 ppm, and where the at least one amine has a pKa between about 10.7 and about 11.4; and at least one amine salt that is less corrosive as compared to amine salts that would otherwise form without the contacting of the composition comprising the at least one amine.

16. The treated hydrocarbon stream of claim 15 where the stream is selected from the group consisting of a desalted crude oil stream, a distillation overhead stream and combinations thereof.

17. The treated hydrocarbon stream of claim 15 where the at least one amine is selected from the group consisting of dimethylamine, diethylamine, dipropylamine, diisopropylamine, di-n-butylamine, diisobutylamine, di-sec-butylamine, di-tert-butylamine, pyrrolidine, piperidine, and combinations thereof.

18. The treated hydrocarbon stream of claim 15 where the stream further comprises a nitrogen-containing compound selected from the group consisting of ammonia, a tramp amine, a residual amine, a volatile and combinations thereof capable of forming at least one corrosive salt with the at least one mineral acid, where the at least one amine is different from the tramp amine, residual amine, or volatile amine, and the amount of amine is greater than total amount of nitrogen-containing compound to give a treated stream.

19. The treated hydrocarbon stream of claim 18 where the pH of the water of the treated hydrocarbon stream is about 5.5 to about 7.5.

20. The treated hydrocarbon stream of claim 15 where the at least one amine is selected from the group consisting of di-n-butylamine, diisobutylamine, di-sec-butylamine, di-tert-butylamine, and combinations thereof.

* * * * *